US010107236B2

(12) United States Patent
Kuske et al.

(10) Patent No.: US 10,107,236 B2
(45) Date of Patent: Oct. 23, 2018

(54) EXHAUST GAS TEMPERATURE REGULATION IN A BYPASS DUCT OF AN EXHAUST GAS RECIRCULATION SYSTEM

(71) Applicant: Ford Global Technologies, LLC, Dearborn, MI (US)

(72) Inventors: Andreas Kuske, Geulle (NL); Christian Winge Vigild, Aldenhoven (DE); Franz Arnd Sommerhoff, Aachen (DE); Joerg Kemmerling, Monschau (DE); Helmut Matthias Kindl, Aachen (DE); Vanco Smiljanovski, Bedburg (DE); Hanno Friederichs, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 127 days.

(21) Appl. No.: 15/405,221

(22) Filed: Jan. 12, 2017

(65) Prior Publication Data

US 2017/0198665 A1 Jul. 13, 2017

(30) Foreign Application Priority Data

Jan. 13, 2016 (DE) ..... 10 2016 200 284

(51) Int. Cl.
*F02M 26/25* (2016.01)
*F02M 26/28* (2016.01)

(52) U.S. Cl.
CPC ..... *F02M 26/25* (2016.02); *F02M 26/28* (2016.02)

(58) Field of Classification Search
CPC ..... F02M 26/25; F02M 26/27; F02M 26/28; F02M 26/31; F02M 26/32
See application file for complete search history.

(56) References Cited

U.S. PATENT DOCUMENTS

| | | | | |
|---|---|---|---|---|
| 6,718,956 | B2 * | 4/2004 | Klipfel | F28D 7/1669 123/568.12 |
| 7,717,097 | B2 * | 5/2010 | Guerrero | F02B 29/0412 123/542 |
| 7,845,338 | B2 | 12/2010 | Smith et al. | |
| 2008/0223024 | A1 * | 9/2008 | Kammler | F01N 5/02 60/320 |
| 2009/0260586 | A1 * | 10/2009 | Geskes | F02B 29/0462 123/41.48 |
| 2013/0042842 | A1 | 2/2013 | Vassallo et al. | |

(Continued)

FOREIGN PATENT DOCUMENTS

| | | | |
|---|---|---|---|
| DE | 10355649 | A1 | 12/2005 |
| DE | 102010043750 | A1 | 5/2012 |
| WO | 2014049344 | A2 | 4/2014 |

*Primary Examiner* — Hung Q Nguyen
*Assistant Examiner* — Mark L Greene
(74) *Attorney, Agent, or Firm* — Julia Voutyras; McCoy Russell LLP

(57) ABSTRACT

An exhaust gas recirculation system is provided in a motor vehicle to pass exhaust gas out of an exhaust tract into an intake tract of a motor vehicle, said system having a cooler device and a bypass duct, wherein the bypass duct is bounded by a double wall, which can be filled with a gas to thermally insulate the bypass duct and with a liquid to cool or heat the bypass duct. A method for controlling the temperature of a bypass duct of the exhaust gas recirculation system is furthermore provided.

20 Claims, 6 Drawing Sheets

(56) References Cited

U.S. PATENT DOCUMENTS

| | | | | |
|---|---|---|---|---|
| 2015/0128587 | A1* | 5/2015 | Dane | F02M 45/02<br>60/605.2 |
| 2015/0308388 | A1* | 10/2015 | Castano Gonzalez | F28D 7/16<br>123/568.12 |

* cited by examiner

598

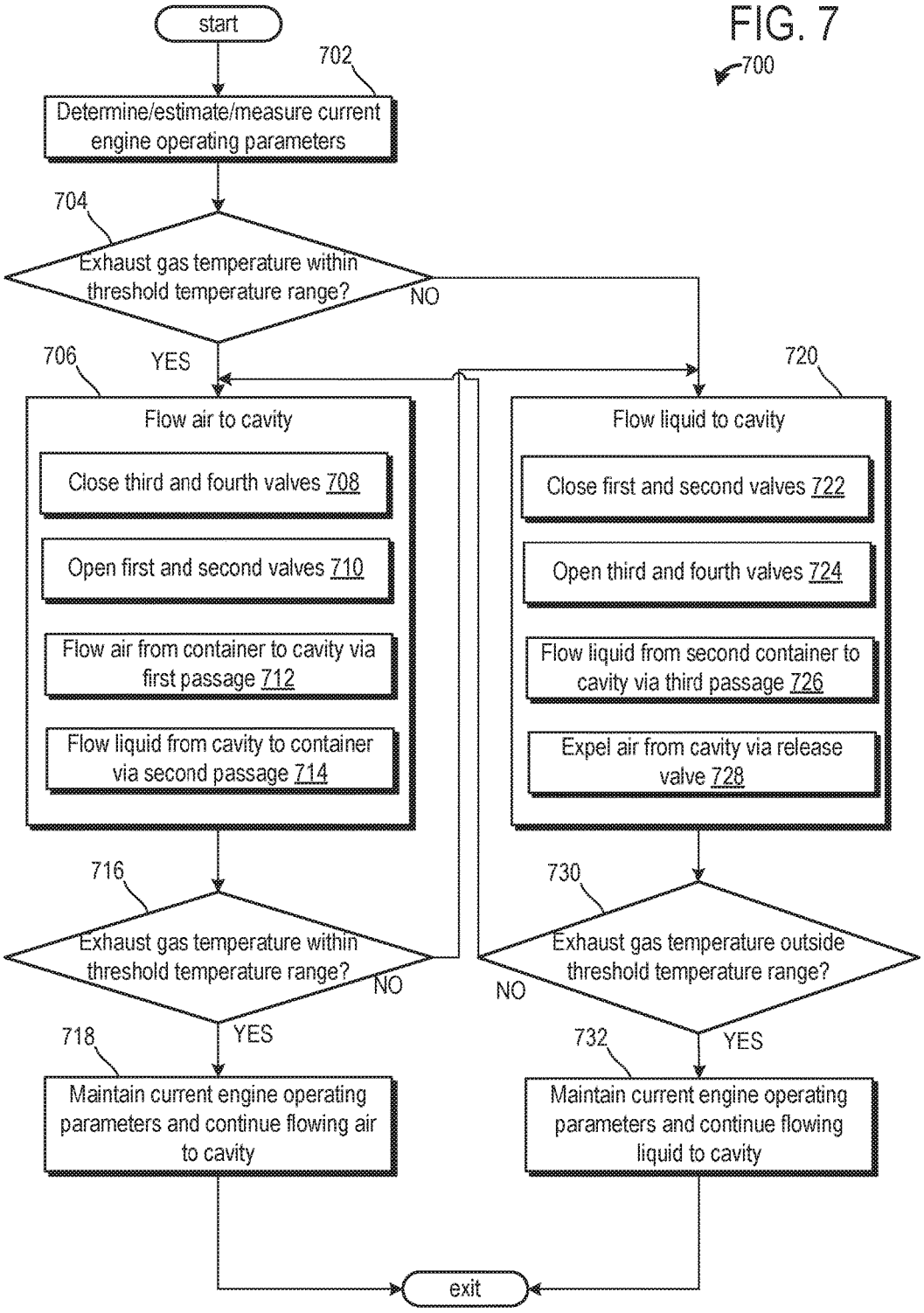
FIG. 7
700
start
702
Determine/estimate/measure current engine operating parameters
704
Exhaust gas temperature within threshold temperature range?
NO
YES
706
Flow air to cavity
Close third and fourth valves 708
Open first and second valves 710
Flow air from container to cavity via first passage 712
Flow liquid from cavity to container via second passage 714
720
Flow liquid to cavity
Close first and second valves 722
Open third and fourth valves 724
Flow liquid from second container to cavity via third passage 726
Expel air from cavity via release valve 728
716
Exhaust gas temperature within threshold temperature range?
NO
YES
730
Exhaust gas temperature outside threshold temperature range?
NO
YES
718
Maintain current engine operating parameters and continue flowing air to cavity
732
Maintain current engine operating parameters and continue flowing liquid to cavity
exit

EXHAUST GAS TEMPERATURE REGULATION IN A BYPASS DUCT OF AN EXHAUST GAS RECIRCULATION SYSTEM

CROSS REFERENCE TO RELATED APPLICATION

The present application claims priority to German Patent Application No. 102016200284.8, filed on Jan. 13, 2016. The entire contents of the above-referenced application are hereby incorporated by reference in its entirety for all purposes.

FIELD

The present disclosure relates to an exhaust gas recirculation (EGR) system having a cooler device and a bypass duct, which is surrounded by a double wall with a cavity that can be filled with a gas or a liquid to control the temperature of the bypass duct.

BACKGROUND/SUMMARY

After starting, combustion engines desire to warm up rapidly to reduce fuel consumption and keep pollutant emissions low. Recirculation of exhaust gas, also referred to as exhaust gas recirculation (EGR), is an efficient method of assisting the heating of the combustion engine after starting. In this case, the exhaust gas is passed from the exhaust tract, by an EGR system, into the intake tract of the combustion engine. The EGR system may comprise a cooler device for cooling the exhaust gas. This cooler device may not be operated continuously, e.g. if the exhaust gas is supposed to maintain its temperature. For example, the cooler device may be disabled or bypassed during the engine start where an engine temperature is less than a threshold temperature (e.g., a cold-start). However, even if it is not being operated, the cooler device has a thermal mass which absorbs heat from the exhaust gas. For this reason, a bypass duct, by means of which exhaust gas can be diverted passed the cooler device may be arranged in the EGR system. The bypass duct has a smaller thermal mass than the cooler device, ensuring that the exhaust gas releases less heat when it is passed through the bypass duct. Under starting conditions however, while the walls of the bypass duct are still cold, the exhaust gas also releases heat to the material of the bypass duct.

With increasing time in operation of the combustion engine, the EGR system and hence also the casing of the bypass duct can be greatly heated by exhaust gas, making it desirable to apply cooling to protect the housing from excessive heating. Depending on the operating state, there are various thermal demands on a bypass duct configuration. Under starting conditions, thermally insulating the bypass duct may limit heat loss to the environment. As the time in operation increases, however, an increasing amount of heat from the exhaust gas is generally also transferred to the material of the bypass duct, even if it flows through the cooler device and not directly through the bypass duct. It is therefore the object of the present disclosure to provide a thermal insulation for the bypass duct which can also be used as thermal protection for the material of the bypass duct.

In one example, the issues described above may be addressed by an EGR system in a motor vehicle for passing exhaust gas out of an exhaust tract into an intake tract of a motor vehicle, said system having a duct with a cooler device and a bypass duct, in which the bypass duct is bounded in a radial direction by a double wall with a cavity which is in fluid connection in each case via at least one opening in an outer wall of the double wall with a first flow circuit and a second flow circuit and which can be filled with gas or liquid to control the temperature of the bypass duct.

In this way, the system allows both thermal insulation and cooling or heating of the bypass duct, depending on the operating situation. For thermal insulation of the bypass duct, the cavity may be filled with gas to restrict heat loss from the recirculated exhaust gas. The cooling and heating of the bypass duct is dependent on the temperature of the fluid medium, (e.g., a liquid), in particular, a liquid coolant, relative to the temperature of the exhaust gas. The bypass duct is cooled when the fluid medium is warmer than the exhaust gas. Cooling may be performed to avoid overheating of the bypass duct. Moreover, it is possible, via both the thermal insulation and the heating of the bypass duct, to control the temperature of the bypass duct in such a way that the exhaust gas releases as little heat as possible or that heat is fed to the exhaust gas. To heat the bypass duct, the fluid medium has a temperature which is higher than the temperature of the exhaust gas. The fluid medium can be used, in particular, for heating when it has not yet cooled after absorbing heat from the exhaust gas and is warmer than cool exhaust gas, which is formed in the starting phase and in low-load phases of the combustion engine, for example. The exhaust gas heats up during this process and, in addition to counteracting condensation, there is the advantageous effect that the combustion engine reaches an operating temperature more quickly or does not cool down too much below said temperature. Moreover, thermal insulation or heating has the advantageous effect that as little as possible water contained in the exhaust gas condenses, water which, during an operating phase in which no exhaust gas is being recirculated and an exhaust gas recirculation valve in the EGR system is closed, could agglomerate into large droplets which enter the compressor of a turbocharger when the EGR valve is opened and could cause damage due to droplet impact. The EGR system is a low-pressure EGR system, in some examples, but may also be a high-pressure EGR system without departing from the scope of the present disclosure.

The term "flow circuit" refers to an arrangement of devices in which a fluid medium, e.g., a gas or a liquid, can flow and the flow of the medium is controlled. The flow circuit may or may not comprise a closed circuit for the medium. It is also possible for different media to flow in a flow circuit.

In the system according to the present disclosure, the first flow circuit has at least one first line with at least one first valve and at least one second line with at least one second valve. The lines allow the cavity to be filled with gas and liquid to be evacuated from the cavity while it is being filled with gas. As gas, it is possible to use air or some other suitable gas, for example, and, as liquid, to use water or some other liquid suitable as a cooling liquid.

At least one pump is arranged in the first flow circuit of the system. The pump is used to evacuate the liquid from the cavity in the double wall of the bypass duct. A pump, which is used particularly to pump the liquid into the cavity, is likewise arranged in the second flow circuit.

The first flow circuit of the system comprises a container, in which there is a gas in a first subregion and a liquid in a second subregion. Here, the gas is provided to fill the cavity, and the liquid is supplied from the cavity. The use of the container is may monitor that the gas volume introduced corresponds to the liquid volume discharged as the gas in the cavity in the common container is replaced by liquid.

It is also possible for the first flow circuit of the system to comprise a separate gas reservoir. The gas reservoir is a pressurized gas container, e.g. a compressed air cylinder, wherein the gas used is air, in one example. In this embodiment, the first flow circuit has a separate first liquid reservoir. The first liquid reservoir is used to receive a liquid evacuated from the cavity. In this case, the first liquid reservoir may be integrated with the gas reservoir in a single unit.

In the system, the second flow circuit comprises at least one third line with at least one third valve and at least one fourth line with at least one fourth valve.

The second flow circuit further comprises a second liquid reservoir. A liquid can flow from the second liquid reservoir, via the third line, into the cavity and from the cavity, via the fourth line, back into the second liquid reservoir. The second flow circuit is thus a closed flow circuit. Ideally, the second flow circuit likewise has a pump for producing a flow. It is possible for the first liquid reservoir to be connected to the second liquid reservoir to feed liquid evacuated from the cavity during filling with gas back to the second circuit.

A first method for controlling the temperature of exhaust gas recirculated through the bypass duct of the EGR system, wherein the cavity is filled with a gas or a liquid depending on the operating situation is described in greater detail below Specifically, a controller with instructions stored thereon that when executed enable the controller to carry out thermal insulation of the bypass duct, which includes closing the third and fourth valves, opening the first and second valves, evacuating liquid from the cavity via the second line while simultaneously filling the cavity with gas via the first line, and closing the first and second valves. In the method, the initial situation is one in which the cavity is initially filled with a liquid or in which at least a volume of liquid is present in the cavity, said liquid being removed from the cavity as gas flows into the cavity. This can be the case under starting conditions, for example, wherein liquid from a previous operation of the system is still present in the cavity. It is furthermore possible, by means of the method, to transfer the bypass duct during operation from a cooling mode, in which the material of the bypass duct and of a housing surrounding the bypass duct are protected from excessive heating, to a thermal insulation mode, in which the exhaust gas temperature is maintained as far as possible.

The controller further includes instructions stored thereon that when executed enable the controller to carry out a second method to cool the bypass duct, where the second method includes closing the first and second valves, opening the third and fourth valves, and evacuating the gas from the cavity via a gas valve while simultaneously introducing into the cavity a liquid which is cooler than an exhaust gas passed through the bypass duct, said liquid flowing at a constant rate from the third line, through the cavity, into the fourth line.

In the additional steps, the material of the bypass duct may cool if it overheats with increasing time in operation of the combustion engine. If the bypass duct is to be thermally insulated again at another, later time, e.g. in an operating state with cooler exhaust gas, the controller may switch from operating the second method to initiating the first method. It will be appreciated that the controller may also switch from the first method to the second method when desired. It is thus possible to switch between thermal insulation, heating and cooling of the bypass duct, depending on requirements or the operating state.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 7 shows a method for operating one or more flow circuits and corresponding valves and/or pumps located therein in response to a sensed temperature of an EGR cooler bypass and/or exhaust gas.

DETAILED DESCRIPTION

Figure 1:
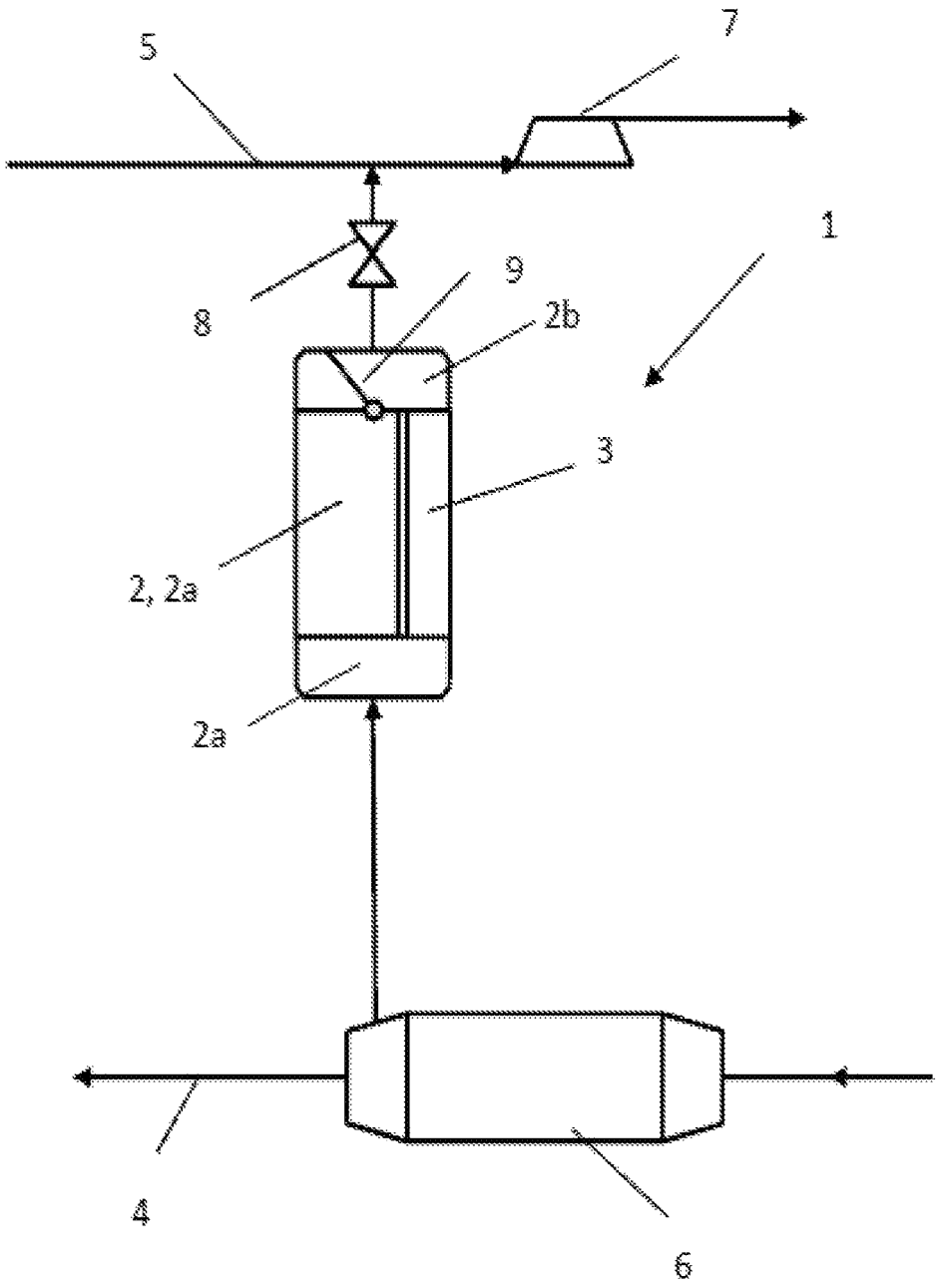
FIG. 1 shows a schematic illustration of an exhaust system having an exhaust gas recirculation (EGR) system.
Figure 2:
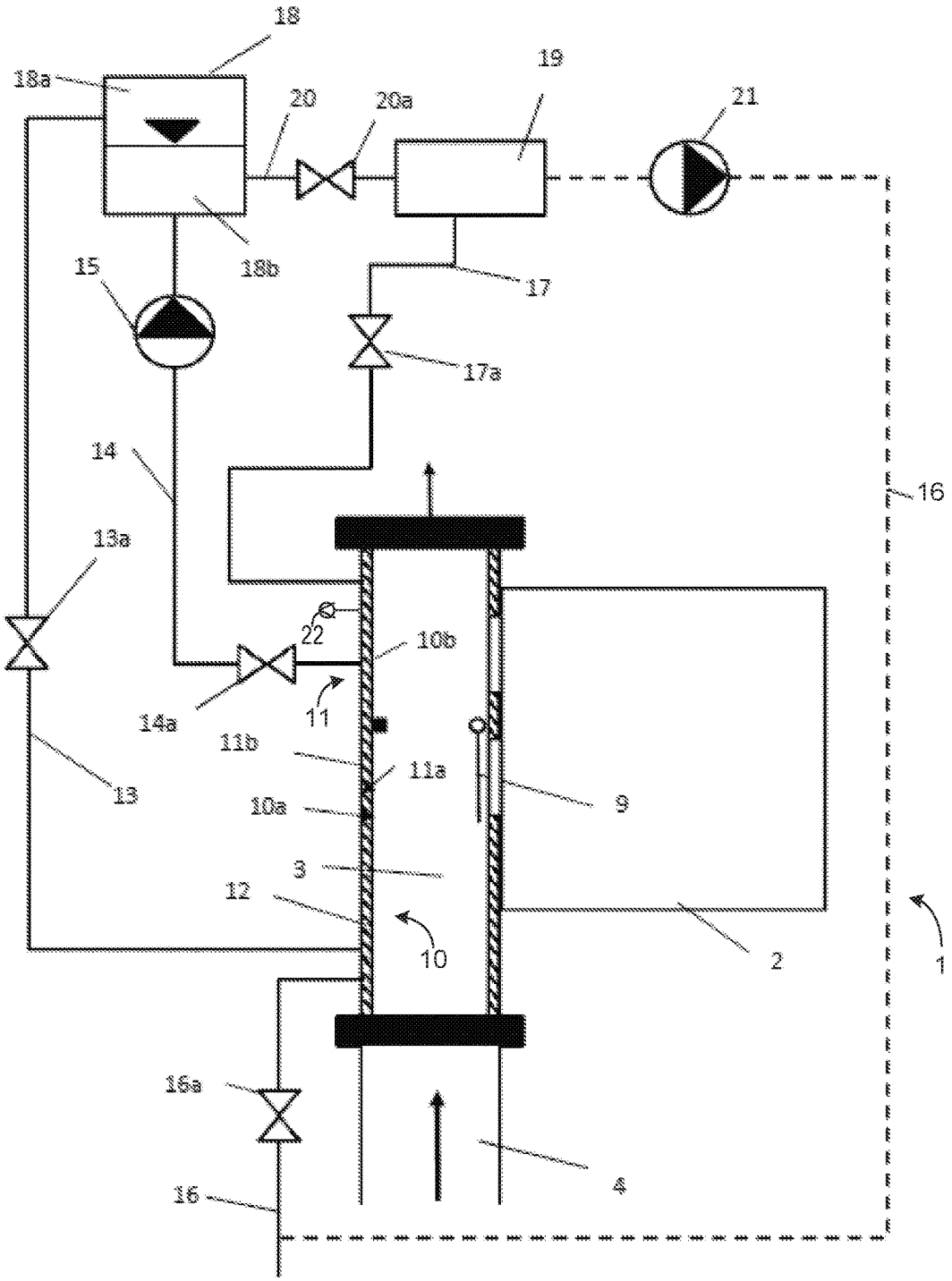
FIG. 2 shows a schematic illustration of an embodiment of the EGR system.
Figure 3:
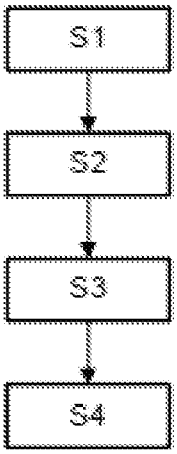
FIG. 3 shows a flow diagram of an embodiment of the method.
Figure 4:
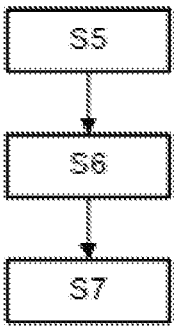
FIG. 4 shows a flow diagram of another embodiment of the method.
Figure 5B:
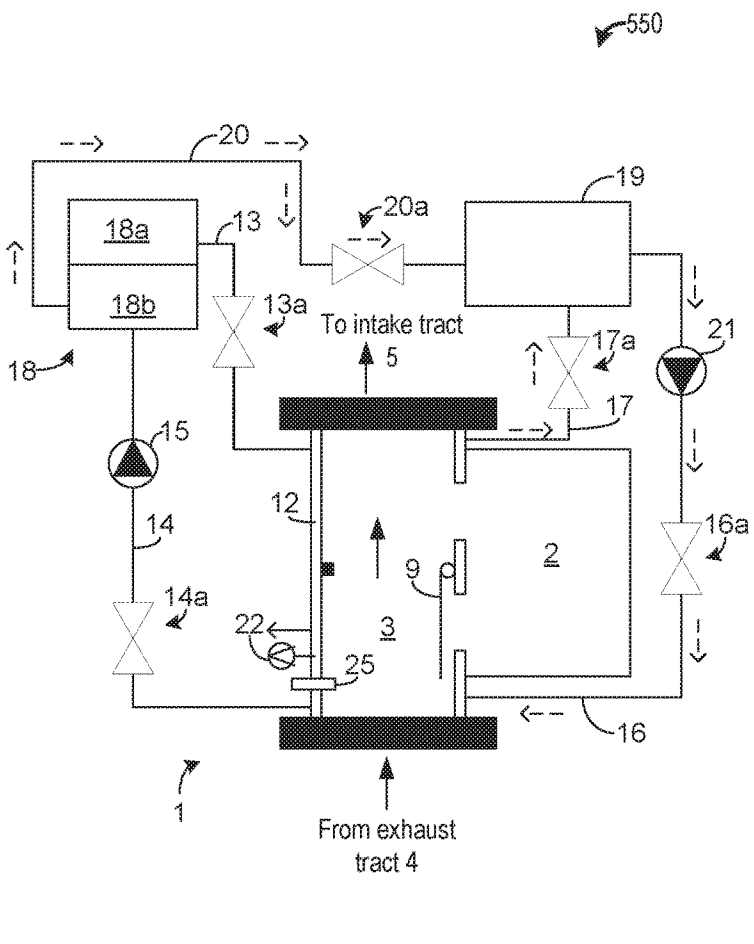
FIGS. 5A and 5B show a direction of air and liquid flow through the circuits and cavity of the EGR system.
Figure 5A:
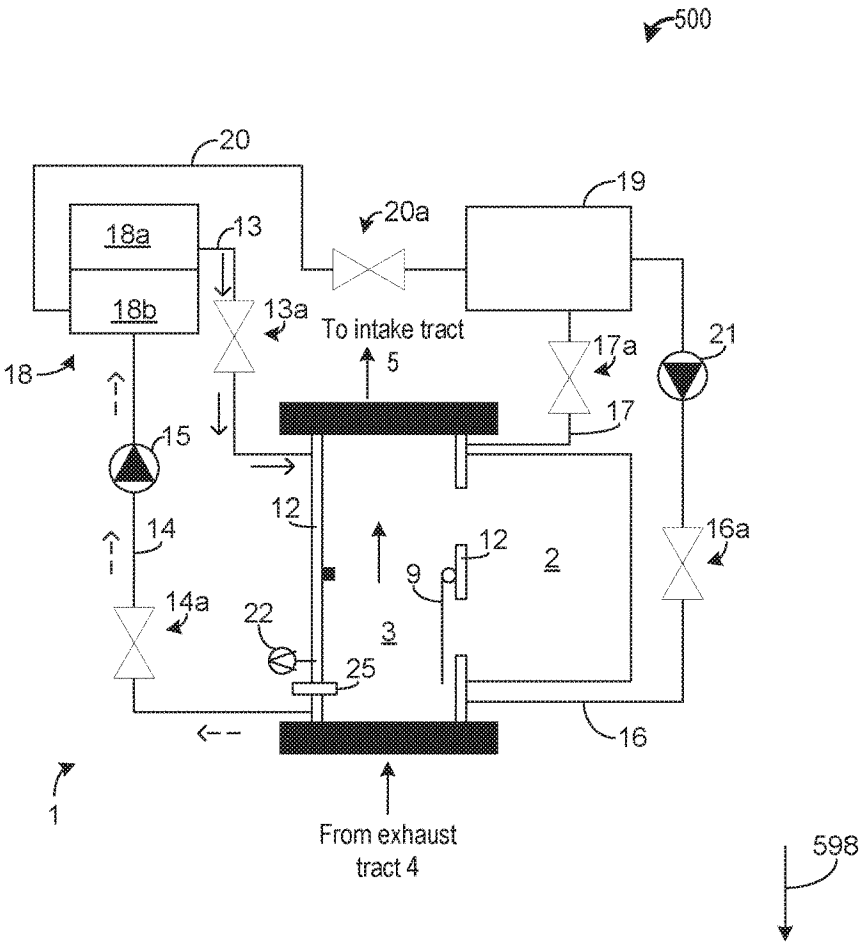
Figure 6:
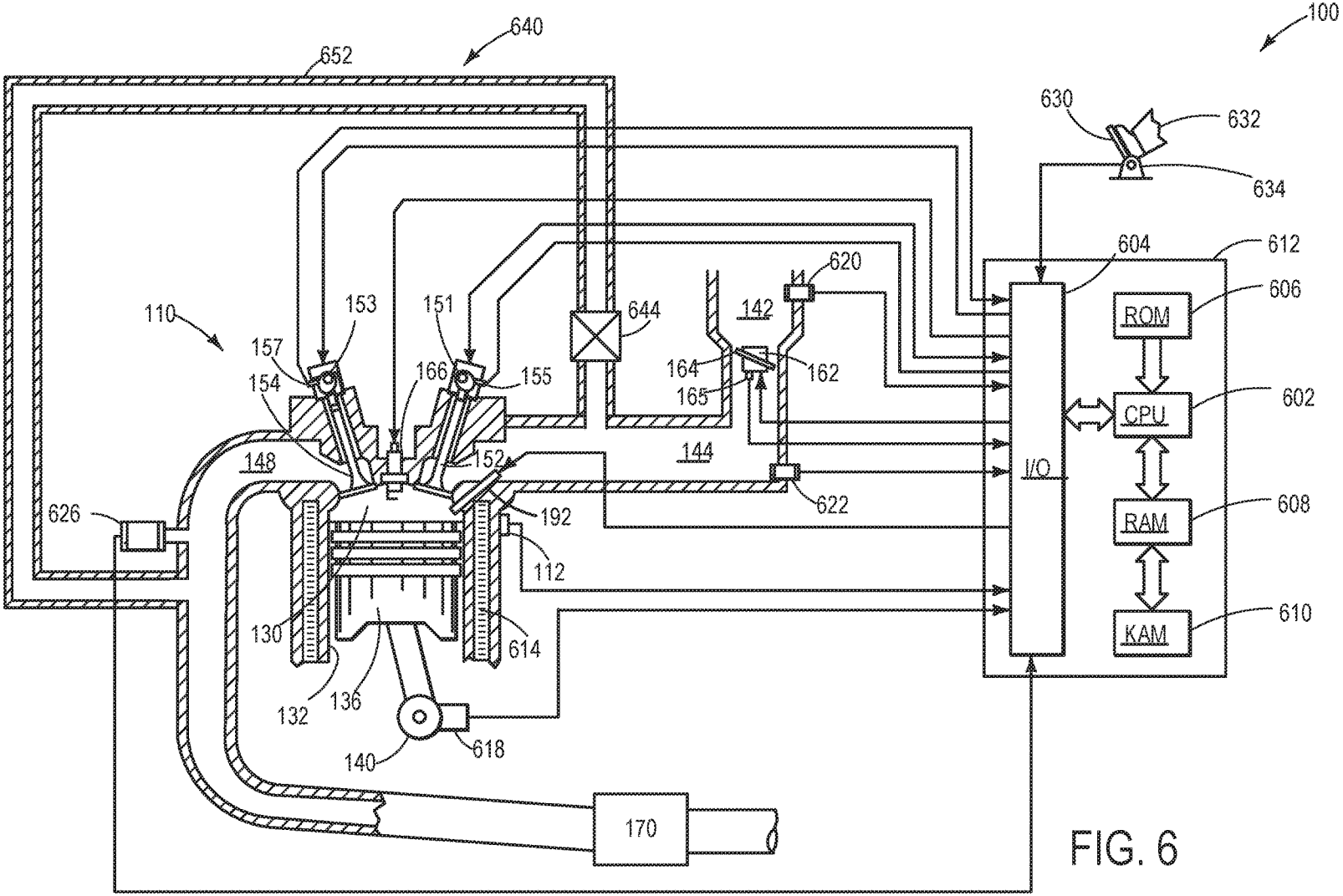
FIG. 6 shows an engine having a cylinder configured to be used with the EGR system of FIG. 1.

The following description relates to systems and methods for flowing one or more types of coolants to a cavity located between separated walls of an EGR cooler bypass. A low-pressure (LP) EGR system comprising the above described EGR cooler and EGR cooler bypass is shown in FIG. 1. An engine for propelling a vehicle, the engine configured to utilize an EGR system which may be substantially similar to the EGR system illustrated in FIG. 1 is shown in FIG. 6. A detailed view of one or more flow circuits fluidly coupled to the EGR cooler duct is shown in FIG. 2. A direction of air and fluid flow is shown in FIGS. 5A and 5B. High-level flow charts of flowing air or flowing liquid to the EGR cooler bypass is shown in FIGS. 3 and 4, respectively. A flow chart for operating the flow circuits and corresponding valves based on a sensed temperature of the EGR bypass and/or exhaust gas is shown in FIG. 7.

FIGS. 1, 2, 5A, 5B, and 6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

An EGR system 1 in accordance with the illustration in FIG. 1 comprises an inlet duct 2*a*, a duct with a cooler device 2, a bypass duct 3, and an outlet duct 2*b*, through which the exhaust gas can be passed. By means of the EGR system 1, exhaust gas is passed out of an exhaust tract 4 into an intake tract 5. The EGR system 1 branches off from the exhaust tract 4 downstream of an exhaust gas aftertreatment system 6, in which catalysts, such as oxidation catalysts, three-way catalysts, or filters, e.g. diesel particulate filters, are arranged. The EGR system 1 opens into the intake tract 5 upstream of a compressor 7 of an exhaust turbocharger. The flow of exhaust gas from the EGR system 1 into the intake tract 5 is controlled by an EGR valve 8. An EGR bypass valve 9 is used to control whether or in what proportions exhaust gas flows through the cooler device 2 or the bypass duct 3 of the EGR system 1. The EGR system shown in FIG. 1 is a low-pressure EGR system. As an alternative, the EGR system can also be a high-pressure EGR system.

The EGR system 1 is shown in detail in FIG. 2. The EGR system 1 comprises a cooler device (e.g., an EGR cooler) 2 and a bypass duct (e.g., an EGR cooler bypass duct) 3. The bypass duct 3 is bounded in a radial direction by a double wall consisting of an inner wall 10 and an outer wall 11. The inner wall 10 has an inner side 10*a* facing a cavity 12 and an outer side 10*b* facing the flow side of the exhaust gas. The outer wall 11 has an inner side 11*a* facing the cavity 12 and an outer side 11*b* facing the environment, e.g. facing a casing of the bypass duct 3 or of the EGR system 1. The cavity 12 between the walls is thus bounded by the inner side 10*a* of the inner wall 10 and the inner side 11*a* of the outer wall 11. As such, the outer side 10*b* may come into contact with exhaust gas flowing through the bypass duct 3. In this way, the cavity 12 represents a volume and/or reservoir located between the outer 11 and inner 10 walls. The cavity 12 is configured to receive one or more coolants based on engine operating parameters. Specifically, the cavity 12 is configured to receive coolants in different physical states (e.g., liquid and gas) based on an exhaust gas temperature.

The cavity 12 is connected via its outer wall 11 to a first line 13, via which a gas can be introduced into the cavity 12. The first line 13 has a first valve 13*a*. The cavity 12 is furthermore connected via a cutout in its outer wall 11 to a second line 14, which has a second valve 14*a*. A first pump 15 is arranged in the second line 14. The cavity 12 is furthermore connected via a cutout its outer wall 11 to a third line 16, which has a third valve 16*a*. The cavity 12 is furthermore connected via a cutout in its outer wall 11 to a fourth line 17, which has a fourth valve 17*a*. The first 13 and the second line 14 belong to a first flow circuit, and the third 16 and the fourth line 17 belong to a second flow circuit. The cavity 12 has a fluid connection to both flow circuits. However, as shown, none of the first 13, second 14, third 16, and fourth 17 lines are directly fluidly coupled. Said another way, an intervening component is located between each of the first 13, second 14, third 16, and fourth 17 lines. The arrows indicate the direction of flow of the exhaust gas.

Arranged in the first flow circuit (e.g., first line 13) is a container 18, in which there is a gas in a first subregion 18*a* and a liquid in a second subregion 18*b*. As liquid is replaced by gas in the cavity 12, it can be ensured in the first container 18 that the gas volume introduced corresponds to the liquid volume discharged. In this case, the gas portion in the first container 18 can be supplemented at any time, e.g. from a compressed air container. Accordingly, in practice, air is used as the gas, although it is also possible to use a different gas. In practice, water or some other suitable liquid can be used as the liquid which serves as a cooling liquid. Excess liquid can be discharged from the container 18 via a separate line, e.g. into the second flow circuit (e.g., second line 14).

In an alternative embodiment, the system can also have a separate gas reservoir, from which a gas for introduction into the cavity 12 can be supplied via the first line 13. The gas reservoir may be a pressurized gas container, e.g. a compressed air container, such as a compressed air cylinder. In some examples, the contents of the container 18 may be re-pressurized via an actuator, where the actuator is coupled to an oscillating component of the vehicle (e.g., the crankshaft). A separate first liquid reservoir for receiving a liquid evacuated from the cavity 12 via the second line 14 is then arranged in spatial proximity to the gas reservoir.

The attachment of the second line 14 to the outer wall 11 is arranged at as low a point as possible of the bypass duct 3 in order to assist the discharge of liquid when gas is introduced into the cavity 12. Here, the volumes of gas introduced and liquid discharged correspond to one another. Via the second line 14, the gas contained in the cavity 12 can also be discharged.

In one example, the first subregion 18*a* may be replenished with air via an auxiliary gas reservoir separate from the compressed air container and the first and second flow circuits. The auxiliary gas reservoir may receive ambient air through a grill or air from the cavity 12 as liquid flows therein. The auxiliary gas reservoir may be configured to compress air located therein via a piston or other element configured to oscillate. The piston may be electrically or mechanically actuated via elements known in the art. For example, rotational energy from an engine piston oscillating may be used to drive the piston of the auxiliary gas reservoir. Alternatively, an electric motor (e.g., a battery) may be used to power the piston of the auxiliary gas reservoir. In this way, a replenishment of pressurized gas for the EGR system 1 is completed without assistance from a vehicle operator.

If a liquid is introduced into the cavity 12 via the third line 16, the gas contained in the cavity 12 escapes to the environment via a gas valve 22 provided for this purpose in the region of the EGR system 1. In one example, the gas valve 22 opens in response to a pressure greater than a threshold release pressure, wherein the threshold release pressure is based on a pressure increase in the cavity 12 as liquid flows into the cavity and compresses the air located therein. As an alternative, the gas can also be discharged into the container 18 via the second line 14 or from the cavity 12 via the fourth line 17 and released into the environment at some other point.

The second flow circuit has a second liquid reservoir 19 and/or second container 19, from which a liquid can flow back into the cavity 12 via the third line 16 and into which it can flow back out of the cavity 12 via the fourth line 17. The container 18 is connected to the second liquid reservoir 19 via a fifth line 20 from the second subregion 18*b* in order to feed liquid from the first flow circuit into the second flow circuit. A fifth valve 20*a* is arranged in the fifth line 20 in order to control the flow of liquid from second subregion 18*b* to the second liquid reservoir 19. In the embodiment that has a separate first liquid reservoir, this can be connected in the same way to the second liquid reservoir. In third line 16, the second flow circuit furthermore has a second pump 21 configured to enable flow of the liquid. The second flow circuit can furthermore have a cooler device in order to discharge absorbed heat from the liquid.

The following description is conjunction with the high-level flow charts illustrated in FIGS. 3 and 4. In accordance with the embodiment of the bypass duct 3 with the cavity 12 formed in the double wall, the cavity can be filled with a gas to thermally insulate the bypass duct 3 when the temperature of the exhaust gas is to be maintained as far as possible, especially under starting conditions, during which the exhaust gas is desired to warm the combustion engine. To detect the current temperature of the exhaust gas and the material of the bypass duct 3, one or more temperature sensors (not shown) are arranged in the region of the bypass duct 3. The temperature sensors are connected to a control unit (e.g., controller 612 of FIG. 6), which controls the valves and pumps of the flow circuits in accordance with requirements. In this case, the bypass duct 3 is thermally insulated in a method for controlling the temperature of the bypass duct 3 by closing the third 16*a* and the fourth 17*a* valves in a first step S1. In a second step S2, the first 13*a* and the second valve 14*a* are opened. It is assumed here that the cavity is filled with a liquid at the beginning of the method or that at least a volume of liquid is present in the cavity 12. In a third step S3, the liquid is discharged from the cavity 12 via the second line 14 and is replaced by gas fed in via the first line 13. Here, the discharge of the liquid is brought about above all through the action of the first pump 15 and is assisted by the gas introduced, which displaces the liquid. The volume of liquid discharged corresponds to that of the gas introduced. In a fourth step, the first 13*a* and second 14*a* valves are closed. The cavity 12 is substantially filled with gas.

If the intention is to cool the bypass duct 3 instead, e.g., to dissipate heat from the material of the bypass duct 3, which can be the case at a time after the starting phase of the operation of the combustion engine, for example, the first 13*a* and the second 14*a* valves are closed in a fifth step S5 in the method. In a sixth step S6, the third 16*a* and the fourth 17*a* valves are opened. In a seventh step S7, the gas is evacuated from the cavity 12 via a gas valve (not shown) while the cavity 12 is simultaneously filled with liquid, which flows out of the third line 16 into the cavity 12 and onward into the fourth line 17 and is at a lower temperature than the exhaust gas.

In another, later operating phase, in which the exhaust gas temperatures are lower still and the bypass duct 3 is once again to be thermally insulated, the liquid is once again discharged from the cavity 12 and gas introduced into the cavity 12 in steps S1 to S4.

As an alternative, it is also possible, where temperatures are too low, for the bypass duct 3 to be heated, e.g., heat can be supplied to the bypass duct 3 and once again transferred to the exhaust gas. Here, the liquid is not cooled during or after a cooling phase of the bypass duct 3; instead, the heat absorbed is used to heat the exhaust gas. For this purpose, the first 13*a* and the second 14*a* valves are closed in a fifth step S5 in the method. In a sixth step S6, the third 16*a* and the fourth 17*a* valves are opened. In a seventh step S7, the gas is evacuated from the cavity 12 via a gas valve (not shown) while the cavity 12 is simultaneously filled with liquid, which flows out of the third line 16 into the cavity 12 and onward into the fourth line 17 and is at a higher temperature than the exhaust gas. The liquid can be warmer than the exhaust gas, for example, if the liquid has previously absorbed a large amount of heat from the exhaust gas and cool exhaust gas is being produced in a current operating phase of the combustion engine.

Thus, a method comprises controlling a temperature of a bypass duct of an exhaust gas recirculation system to thermally insulate or cool a cavity of the bypass duct, wherein the cavity is configured to receive gas or liquid from first and second reservoirs, respectively. Thermally insulating the bypass duct includes flowing air from the first reservoir to the cavity via a first passage having a first valve and flowing liquid out of the cavity to the first reservoir via a second passage having a second valve as air flows into the cavity. The first valve and the second valve are in fully open positions, and where the cavity is further coupled to the second reservoir via third and fourth passages comprising third and fourth valves, respectively, and where the third and fourth valves are in a fully closes position during the thermally insulating.

Cooling the bypass duct includes flowing liquid from the second reservoir to the cavity via the third passage, and where the liquid continuously flows through the second reservoir, third passage, cavity, and fourth passage. The cooling the bypass further includes moving the first and second valves to fully closed positions, and where the cavity expels gas through a gas valve as water flows into the cavity. The controlling further includes heating the bypass duct by flowing liquid to the bypass duct.

Turning now to FIGS. 5A and 5B, they show air and liquid flows during a temperature maintenance operation and a temperature cooling (or heating) operation, respectively. As such, FIG. 5A shows air flowing to the cavity 12 and liquid flowing out of the cavity 12. FIG. 5B shows liquid flowing to the cavity 12 and air flowing out of the cavity 12. Components previously introduced are similar numbered in subsequent figures. Arrow 598 shows a direction of gravity.

As shown, the cavity 12 is annular and surrounds the bypass duct 3. As such, the double wall configuration is located around an entirety of the bypass duct 3.

In the embodiment 500, first 13*a* and second 14*a* valves are in fully open positions. Third 16*a* and fourth 17*a* valves are in fully open positions. As such, third 16*a* and fourth 17*a* valves are hermetically sealed, preventing passage of fluids through the third 16 and fourth 17 passages. Said another way, neither air nor liquid flows through the third 16 and fourth lines 17. Additionally, the first 13*a* and second 14*a* valves fluidly connect the container 18 to the cavity 12, allowing air and liquid to flow therebetween. Specifically, air flows through the first valve 13*a* in the fully open position in the first line 13 to the cavity 12. As air flows into the cavity 12, liquid is evacuated from the cavity 12 through the second line 14 via the first pump 15 with assistance from air entering the cavity 12. That is to say, air entering the cavity, along with gravity, may push the liquid down toward the second line 14, where these forces along with first pump 15 direct the liquid through the open second valve 14*a* and into the second subregion 18*b* of the container 18. A volume of liquid entering the container 18 is substantially equal to a volume of air leaving the container 18 and flowing to the cavity 12. By flowing air to the cavity 12, the bypass duct 3 may insulate exhaust gas flowing therethrough, thereby reducing and/or preventing heat exchange between the exhaust gas and the cavity 12. In this way, an exhaust gas temperature may remain within a desired range (e.g., not too hot or too cold). As such, when air flow to the cavity 12, liquid does not.

As shown, air only flows through the first line 13. Air from the first subregion 18*a* does not enter the second 14, third 16, fourth 17, and fifth 20 lines. Alternatively, liquid flows only through the second 14, third 16, fourth 17, and fifth 20 lines, in one example. Liquid does not flow through the first line 13.

In the embodiment 550, the first 13*a* and second 14*a* valves are in fully closed positions. As such, liquid and air may not flow between the cavity 12 and first container 18. The third 16*a* and fourth 17*a* valves are in fully open positions. In this way, liquid may flow between the cavity 12 and the second container 19 via the third 16 and fourth 17 lines. As liquid flows from the third line 16 to the cavity 12, air is released from the cavity 12, through the gas valve 22 and into either an ambient atmosphere or an auxiliary reservoir as described above. Liquid may flow to the cavity in response to a sensed exhaust gas temperature being outside of the desired temperature range. The exhaust gas temperature may be sensed via a temperature sensor 25. As such, when liquid flow to the cavity 12, liquid does not.

In one example, the liquid coolant may prevent the bypass duct from overheating when the valve 9 is in an open position. That is to say, EGR cooling is not desired, but the exhaust gas is outside of the desired temperature range, wherein the exhaust gas temperature is greater than an upper limit of the desired temperature range, and where the exhaust gas temperature is capable of degrading components of the bypass duct 3. As such, liquid coolant flows to the cavity to provide a small amount of cooling to surfaces of the bypass duct 3 to prevent degradation while minimally cooling, if at all, the exhaust gas flowing through the bypass duct 3.

Additionally or alternatively, the liquid coolant may provide an amount of cooling less than an amount of cooling provided by the EGR cooler 2. As such, the valve 9 may be moved to an open position (as shown) to provide less cooling via the bypass duct 3. In this way, the EGR system 1 comprises greater cooling control by providing more cooling in the EGR cooler 2 and less cooling in the bypass duct 3 when a temperature of the liquid flowing to the cavity 12 is less than a temperature of exhaust gas.

In other examples, the liquid coolant may heat exhaust gas flowing through the bypass duct. When a temperature of the liquid flowing to the cavity 12 is greater than an exhaust gas temperature, the liquid in the cavity may increase a temperature of exhaust gas flowing through the bypass duct 3. This may occur when the liquid is exposed to high exhaust gas temperatures followed by a decrease in exhaust gas temperature, which may occur due to decrease in engine load, engine shut-off, etc. As such, the flow of liquid to the cavity may assist exhaust temperature increasing toward the desired temperature range.

Additionally or alternatively, the fifth valve 20*a* of the fifth passage 20 may be open when liquid is flowing from the third passage 16 to the cavity 12. Liquid from the subregion 18*b* of the first container 18 flows through a fully open fifth valve 20*a* of the fifth passage 20 and into the second container 19. In some examples, liquid from the subregion 18*b* may be a different temperature than liquid in the second container 19. As such, the fifth valve 20*a* may be opened to adjust a temperature of the liquid flowing to the cavity 12. In one example, if liquid is flowing to the cavity 12 to prevent overheating of surfaces in the bypass duct 3, then the liquid in the cavity 12 and second container 19 may be hotter than liquid in the subregion 18*b*. As such, the fifth valve 20*a* may be opened to further prevent overheating of the bypass duct 3.

Continuing to FIG. 6, a schematic diagram showing one cylinder of a multi-cylinder engine 110 in an engine system 100, which may be included in a propulsion system of an automobile, is shown. The engine 110 may be controlled at least partially by a control system including a controller 612 and by input from a vehicle operator 632 via an input device 630. In this example, the input device 630 includes an accelerator pedal and a pedal position sensor 634 for generating a proportional pedal position signal. A combustion chamber 130 of the engine 110 may include a cylinder formed by cylinder walls 132 with a piston 136 positioned therein. The piston 136 may be coupled to a crankshaft 140 so that reciprocating motion of the piston is translated into rotational motion of the crankshaft. The crankshaft 140 may be coupled to at least one drive wheel of a vehicle via an intermediate transmission system. Further, a starter motor may be coupled to the crankshaft 140 via a flywheel to enable a starting operation of the engine 110.

The combustion chamber 130 may receive intake air from an intake manifold 144 via an intake passage 142 and may exhaust combustion gases via an exhaust passage 148. The intake manifold 144 and the exhaust passage 148 can selectively communicate with the combustion chamber 130 via respective intake valve 152 and exhaust valve 154. In some examples, the combustion chamber 130 may include two or more intake valves and/or two or more exhaust valves.

In this example, the intake valve 152 and exhaust valve 154 may be controlled by cam actuation via respective cam actuation systems 151 and 153. The cam actuation systems 151 and 153 may each include one or more cams and may utilize one or more of cam profile switching (CPS), variable cam timing (VCT), variable valve timing (VVT), and/or variable valve lift (VVL) systems that may be operated by the controller 612 to vary valve operation. The position of the intake valve 152 and exhaust valve 154 may be determined by position sensors 155 and 157, respectively. In alternative examples, the intake valve 152 and/or exhaust valve 154 may be controlled by electric valve actuation. For example, the combustion chamber 130 may alternatively include an intake valve controlled via electric valve actuation and an exhaust valve controlled via cam actuation including CPS and/or VCT systems.

A fuel injector 169 is shown coupled directly to combustion chamber 130 for injecting fuel directly therein in proportion to the pulse width of a signal received from the controller 612. In this manner, the fuel injector 169 provides what is known as direct injection of fuel into the combustion chamber 130. The fuel injector may be mounted in the side of the combustion chamber or in the top of the combustion chamber, for example. Fuel may be delivered to the fuel injector 169 by a fuel system (not shown) including a fuel tank, a fuel pump, and a fuel rail. In some examples, the combustion chamber 130 may alternatively or additionally include a fuel injector arranged in the intake manifold 144 in a configuration that provides what is known as port injection of fuel into the intake port upstream of the combustion chamber 130.

Spark is provided to combustion chamber 130 via spark plug 166. The ignition system may further comprise an ignition coil (not shown) for increasing voltage supplied to spark plug 166. In other examples, such as a diesel, spark plug 166 may be omitted.

The intake passage 142 may include a throttle 162 having a throttle plate 164. In this particular example, the position of throttle plate 164 may be varied by the controller 612 via a signal provided to an electric motor or actuator included with the throttle 162, a configuration that is commonly referred to as electronic throttle control (ETC). In this manner, the throttle 162 may be operated to vary the intake air provided to the combustion chamber 130 among other engine cylinders. The position of the throttle plate 164 may be provided to the controller 612 by a throttle position signal. The intake passage 142 may include a mass air flow sensor 620 and a manifold air pressure sensor 622 for sensing an amount of air entering engine 110.

An exhaust gas sensor 626 is shown coupled to the exhaust passage 148 upstream of an emission control device 170 according to a direction of exhaust flow. The sensor 626 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a $NO_x$, HC, or CO sensor. In one example, upstream exhaust gas sensor 626 is a UEGO configured to provide output, such as a voltage signal, that is proportional to the amount of oxygen present in the exhaust. Controller 612 converts oxygen sensor output into exhaust gas air-fuel ratio via an oxygen sensor transfer function.

The emission control device 170 is shown arranged along the exhaust passage 148 downstream of the exhaust gas sensor 626. The device 170 may be a three way catalyst (TWC), $NO_x$ trap, various other emission control devices, or combinations thereof. In some examples, during operation of the engine 110, the emission control device 170 may be periodically reset by operating at least one cylinder of the engine within a particular air-fuel ratio.

An exhaust gas recirculation (EGR) system 640 may route a desired portion of exhaust gas from the exhaust passage 148 to the intake manifold 144 via an EGR passage 652. EGR system 640 may be used substantially similarly to EGR system 1 shown in FIGS. 1, 2, and 5A and 5B. The amount of EGR provided to the intake manifold 144 may be varied by the controller 612 via an EGR valve 644. Under some conditions, the EGR system 640 may be used to regulate the temperature of the air-fuel mixture within the combustion chamber, thus providing a method of controlling the timing of ignition during some combustion modes.

The controller 612 is shown in FIG. 6 as a microcomputer, including a microprocessor unit 602, input/output ports 604, an electronic storage medium for executable programs and calibration values shown as read only memory chip 606 (e.g., non-transitory memory) in this particular example, random access memory 608, keep alive memory 610, and a data bus. The controller 612 may receive various signals from sensors coupled to the engine 110, in addition to those signals previously discussed, including measurement of inducted mass air flow (MAF) from the mass air flow sensor 620; engine coolant temperature (ECT) from a temperature sensor 112 coupled to a cooling sleeve 614; an engine position signal from a Hall effect sensor 618 (or other type) sensing a position of crankshaft 140; throttle position from a throttle position sensor 165; and manifold absolute pressure (MAP) signal from the sensor 622. An engine speed signal may be generated by the controller 612 from crankshaft position sensor 618. Manifold pressure signal also provides an indication of vacuum, or pressure, in the intake manifold 144. Note that various combinations of the above sensors may be used, such as a MAF sensor without a MAP sensor, or vice versa. During engine operation, engine torque may be inferred from the output of MAP sensor 622 and engine speed. Further, this sensor, along with the detected engine speed, may be a basis for estimating charge (including air) inducted into the cylinder. In one example, the crankshaft position sensor 618, which is also used as an engine speed sensor, may produce a predetermined number of equally spaced pulses each revolution of the crankshaft.

The storage medium read-only memory 606 can be programmed with computer readable data representing non-transitory instructions executable by the processor 602 for performing the methods described below as well as other variants that are anticipated but not specifically listed.

During operation, each cylinder within engine 110 typically undergoes a four stroke cycle: the cycle includes the intake stroke, compression stroke, expansion stroke, and exhaust stroke. During the intake stroke, generally, the exhaust valve 154 closes and intake valve 152 opens. Air is introduced into combustion chamber 130 via intake manifold 144, and piston 136 moves to the bottom of the cylinder so as to increase the volume within combustion chamber 130. The position at which piston 136 is near the bottom of the cylinder and at the end of its stroke (e.g., when combustion chamber 130 is at its largest volume) is typically referred to by those of skill in the art as bottom dead center (BDC).

During the compression stroke, intake valve 152 and exhaust valve 154 are closed. Piston 136 moves toward the cylinder head so as to compress the air within combustion chamber 130. The point at which piston 136 is at the end of its stroke and closest to the cylinder head (e.g., when combustion chamber 130 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 166, resulting in combustion.

During the expansion stroke, the expanding gases push piston 136 back to BDC. Crankshaft 140 converts piston movement into a rotational torque of the rotary shaft. Finally, during the exhaust stroke, the exhaust valve 154 opens to release the combusted air-fuel mixture to exhaust passage 148 and the piston returns to TDC. Note that the above is shown merely as an example, and that intake and exhaust valve opening and/or closing timings may vary, such as to provide positive or negative valve overlap, late intake valve closing, or various other examples.

As described above, FIG. 1 shows only one cylinder of a multi-cylinder engine, and each cylinder may similarly include its own set of intake/exhaust valves, fuel injector, spark plug, etc. As will be appreciated by someone skilled in the art, the specific routines described below in the flowcharts may represent one or more of any number of processing strategies such as event driven, interrupt-driven, multi-tasking, multi-threading, and the like. As such, various acts or functions illustrated may be performed in the sequence illustrated, in parallel, or in some cases omitted. Like, the order of processing is not necessarily required to achieve the features and advantages, but is provided for ease of illustration and description. Although not explicitly illustrated, one or more of the illustrated acts or functions may be repeatedly performed depending on the particular strategy being used. Further, these figures graphically represent code to be programmed into the computer readable storage medium in controller 612 to be carried out by the controller in combination with the engine hardware, as illustrated in FIG. 1. The controller 612 receives signals from the various sensors of FIG. 6 and employs the various actuators of FIGS. 1 and 6 to adjust engine operation based on the received signals and instructions stored on a memory of the controller. For example, adjusting the bypass valve 9 of FIG. 1 and/or first through fifth valves shown in FIGS. 2, 5A, and 5B may include adjusting an actuator of the valves to adjust exhaust gas flow and/or coolant in a cavity of the bypass duct, respectively. In one example, a temperature sensor (e.g., temperature sensor 25 of FIGS. 5A and 5B) may signal actuation of one or more of the first through fifth valves. For example, if a sensed temperature is greater than a desired exhaust gas temperature range, then the first and second valves are moved to a fully closed position, and the third, fourth, and fifth valves are moved to fully open positions to allow liquid to flow to a cavity of the bypass duct. Alternatively, if the sensed temperature is within the desired exhaust gas temperature range, then the third, fourth, and fifth valves are moved to a fully closed position, and the first and second valves are moved to fully open positions to allow air to flow to the cavity of the bypass duct. This will be described in greater detail below with respect to FIG. 7.

Thus, the combination of FIGS. 5A, 5B, and 6 show a system comprising an EGR system having an EGR cooler and a EGR cooler bypass, where the EGR cooler bypass is double walled with a cavity located therein; a first reservoir comprising first and second subregions, where the first subregion stores air and is fluidly coupled to the cavity via a first passage and where the second subregion stores liquid and is fluidly coupled to the cavity via a second passage, and a second reservoir configured to store liquid, and where third and fourth passages fluidly couple the second reservoir to the cavity. The first passage comprises a first valve between the first subregion and the cavity for controlling an air flow from the first subregion to the cavity, and where the second passage comprises a second valve for controlling a liquid flow from the cavity to the second subregion. The third passage comprises a third valve between the second reservoir and the cavity for controlling water flow from the second reservoir to the cavity, and where the fourth passage comprises a fourth valve for controlling a liquid flow from the cavity to the second reservoir.

A fifth passage fluidly coupling the second subregion of the first reservoir to the second reservoir, the fifth passage further comprising a fifth valve for controlling a liquid flow from the second subregion to the second reservoir. The cavity is annular and surrounds an entirety of the EGR cooler bypass. The gas is air and the liquid is water. The system further comprises a controller with computer-readable instructions that when executed enable the controller to close third and fourth valves of the third and fourth passages, respectively, and open first and second valves of the first and second passages, respectively, to flow gas to the cavity in conjunction with an evacuation of liquid from the cavity to thermally insulate the EGR cooler bypass. The controller further includes instructions that when executed enable the controller to cool the EGR cooler bypass by closing the first and second valves and opening the third and fourth valves to flow liquid to the cavity as gas is forced out of the cavity through a gas valve.

Turning now to FIG. 7, it shows a method for adjusting one or more valves of the first and second circuits in response to a sensed exhaust gas temperature. Instructions for carrying out method 700 may be executed by a controller based on instructions stored on a memory of the controller and in conjunction with signals received from sensors of the engine system, such as the sensors described above with reference to FIG. 6. The controller may employ engine actuators of the engine system to adjust engine operation, according to the methods described below. FIG. 7 may be described in reference to components previously introduced in FIGS. 1-6.

At 702, the method 700 includes determining, estimating, and/or measuring current engine operating parameters. Current engine operating parameters may include one or more of exhaust temperature, ambient temperature, ambient humidity, EGR flow rate, engine speed, vehicle speed, engine temperature, manifold vacuum, throttle position, and air/fuel ratio.

At 704, the method 700 includes determining if an exhaust gas temperature is within a threshold temperature range (e.g., a desired temperature range). The threshold temperature range may be substantially equal to 260-430° C., in one example. The exhaust gas temperature is sensed via one or more temperature sensors located in the bypass duct. If the exhaust gas temperature is within the threshold temperature range, then the method 700 proceeds to 706.

At 706, the method 700 includes flowing air to the cavity. Before flowing air to the cavity, the method 700 operates under the assumption that the cavity is filled with liquid coolant (e.g., water). As such, third and fourth valves of the third and fourth passages, respectively, are moved to fully closed position to prevent liquid flowing to the cavity at 708. First and second valves of the first and second passages are moved to fully open positions, respectively, at 710. This allows air to flow into the cavity via the first passage from a subregion of a container at 712. As the air enter the cavity, liquid is forced out of the cavity and into the second passage, where the liquid is directed to a different subregion of the same container at 714. Once the cavity is filled with air, the exhaust gas temperature is maintained and thermal communication between the exhaust gas and air in the cavity is relatively low compared to liquid in the cavity. In this way, the exhaust gas temperature may remain within the desired temperature range longer than a bypass duct with a single walled outer shell where thermal loss with ambient air may occur.

In some examples, additionally or alternatively, once the cavity is filled with air (e.g., a volume of liquid entering the first container is substantially equal to a volume of the cavity), then the first and second valves may be moved to a closed position and the cavity is sealed from the first and second passages. As such, air located within the cavity does not recirculate and is trapped within the cavity. Alternatively, the first and second valves may remain open and air may continuously recirculate.

At 716, the method 700 compares the exhaust gas temperature to the threshold temperature range, similar to 704 described above. If the exhaust gas temperature is still within the threshold temperature range, then the method 700 proceeds to 718 to maintain current engine operating parameters and continues flowing air to the cavity.

However, if the exhaust gas temperature is outside of the threshold temperature range at 704 or 716, then the method 700 proceeds to 720 to flow liquid to the cavity of the bypass duct. Outside the threshold temperature range may refer to an exhaust gas temperature less than a lower limit of the range or to an exhaust gas temperature greater than an upper limit of the range. In some examples, the method 700 may proceed to flow liquid to the cavity in response to an exhaust gas temperature lower than the threshold range only when a liquid coolant temperature is greater than the exhaust gas temperature. Otherwise, if the exhaust gas temperature is lower than the threshold range and the liquid coolant temperature is less than or equal to the exhaust gas temperature, then the method 700 may continue flowing air to the cavity.

At 720, the method 700 includes flowing liquid to the cavity of the bypass duct, which initially includes closing the first and second valves of the first and second passages, respectively, at 722. This prevents fluid communication between the first container and the cavity. Subsequently, at least the third and fourth valves of the third and fourth passages, respectively, are opened at 724. In this way, the cavity may fluidly communicate with the second container, which houses substantially only liquid, via the third and fourth passages. In some examples, additionally or alternatively, the fifth valve of the fifth passage may move to an open position to allow the first container to flow water to the second container. As described above, operation of the fifth valve may be based on a liquid coolant temperature, in some examples. Liquid flows from the second container to the cavity via the third passage at 726. Additionally, the liquid from the cavity may flow through the fourth passage and back to the second container before returning to the cavity via the third circuit. This may provide cooling to the liquid coolant via an optional heat exchanger located in the third passage. At any rate, the third and fourth valves remain open when flowing liquid to the cavity and liquid recirculates through the third passage, the cavity, the fourth passage, and the second container. As liquid enters the cavity, air within the cavity is compressed and forced out of the cavity via a gas valve at 728.

At 730, the method 700 includes determining if an exhaust gas temperature is outside the threshold temperature range. If the exhaust gas temperature is outside the threshold temperature range, then the method 700 proceeds to 732 to maintain current engine operating parameters and continues to flow liquid to the cavity. If the exhaust gas temperature is within the threshold temperature range and sufficient heating or cooling has occurred, then the method 700 proceeds to 706 to flow air to the cavity, as described above.

In this way, a bypass duct of an EGR cooler may provide increased temperature control of EGR gas flow while preventing degradation of components located therein. By flowing air or liquid to a cavity located between the double walls of the bypass duct, an exhaust gas temperature may be adjusted or maintained. Additionally or alternatively, cooler liquid coolant may be used not only to cool exhaust gas to a lesser extent than that of the EGR cooler, but to also cool surfaces of the bypass duct to mitigate damage caused by overly hot exhaust gas. The technical effect of flowing air and liquid coolants to a cavity of a bypass duct of an EGR cooler is to provide greater temperature control of the bypass duct and exhaust gas flowing therethrough.

A system comprising an exhaust gas recirculation system in a motor vehicle for passing exhaust gas out of an exhaust tract into an intake tract of the motor vehicle, said system having a duct with a cooler device and a bypass duct, in which the bypass duct is bounded in a radial direction by a double wall with a cavity which is in fluid connection in each case via at least one opening in an outer wall of the double wall with a first flow circuit and a second flow circuit and which can be filled with gas or liquid to control the temperature of the bypass duct. A first example of the system further includes where the first flow circuit comprises at least one first line with at least one first valve and at least one second line with at least one second valve. A second example of the system, optionally including the first example, further includes where the first flow circuit comprises a container with a first subregion configured to store gas and a second subregion configured to store liquid. A third example of the system, optionally including the first and/or second examples, further includes where each of the first and second flow circuits comprises at least one pump. A fourth example of the system, optionally including one or more of the first through third examples, further includes where the second flow circuit comprises at least one third line with at least one third valve and at least one fourth line with at least one fourth valve. A fifth example of the system, optionally including one or more of the first through fourth examples, further includes where the second flow circuit further comprises a liquid reservoir fluidly coupled to the third and fourth lines.

A method comprising controlling a temperature of a bypass duct of an exhaust gas recirculation system to thermally insulate or cool a cavity of the bypass duct, wherein the cavity is configured to receive gas or liquid from first and second reservoirs, respectively. A first example of the method further includes where thermally insulating the bypass duct includes flowing air from the first reservoir to the cavity via a first passage having a first valve and flowing liquid out of the cavity to the first reservoir via a second passage having a second valve as air flows into the cavity. A second example of the method, optionally including the first example, further includes where the first valve and the second valve are in fully open positions, and where the cavity is further coupled to the second reservoir via third and fourth passages comprising third and fourth valves, respectively, and where the third and fourth valves are in a fully closes position during the thermally insulating. A third example of the method, optionally including the first a cooling the bypass duct includes flowing liquid from the second reservoir to the cavity via the third passage, and where the liquid continuously flows through the second reservoir, third passage, cavity, and fourth passage. A fourth example of the method, optionally including one or more of the first through third examples, further includes where cooling the bypass further includes moving the first and second valves to fully closed positions, and where the cavity expels gas through a gas valve as water flows into the cavity. A fifth examples of the method, optionally including one or more of the first through fourth examples, further includes where the controlling further includes heating the bypass duct by flowing liquid to the bypass duct.

A system comprising an EGR system having an EGR cooler and a EGR cooler bypass, where the EGR cooler bypass is double walled with a cavity located therein, a first reservoir comprising first and second subregions, where the first subregion stores air and is fluidly coupled to the cavity via a first passage and where the second subregion stores liquid and is fluidly coupled to the cavity via a second passage, and a second reservoir configured to store liquid, and where third and fourth passages fluidly couple the second reservoir to the cavity. A first example of the system further includes where the first passage comprises a first valve between the first subregion and the cavity for controlling an air flow from the first subregion to the cavity, and where the second passage comprises a second valve for controlling a liquid flow from the cavity to the second subregion. A second example of the system, optionally including the first example, further includes where the third passage comprises a third valve between the second reservoir and the cavity for controlling water flow from the second reservoir to the cavity, and where the fourth passage comprises a fourth valve for controlling a liquid flow from the cavity to the second reservoir. A third example of the system, optionally including the first and/or second examples, further includes where a fifth passage fluidly coupling the second subregion of the first reservoir to the second reservoir, the fifth passage further comprising a fifth valve for controlling a liquid flow from the second subregion to the second reservoir. A fourth example of the system, optionally including one or more of the first through third examples, further includes where the cavity is annular and surrounds an entirety of the EGR cooler bypass. A fifth example of the system, optionally including one or more of the first through fourth examples, further includes where the gas is air and the liquid is water. A sixth example of the system, optionally including one or more of the first through fifth examples, further includes where a controller with computer-readable instructions that when executed enable the controller to close third and fourth valves of the third and fourth passages, respectively, and open first and second valves of the first and second passages, respectively, to flow gas to the cavity in conjunction with an evacuation of liquid from the cavity to thermally insulate the EGR cooler bypass. A seventh example of the system, optionally including one or more of the first through sixth examples, further includes where the controller further includes instructions that when executed enable the controller to cool the EGR cooler bypass by closing the first and second valves and opening the third and fourth valves to flow liquid to the cavity as gas is forced out of the cavity through a gas valve.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system comprising:

an exhaust gas recirculation system in a motor vehicle for passing exhaust gas out of an exhaust tract into an intake tract of the motor vehicle, said system having a duct with a cooler device and a bypass duct, in which the bypass duct is bounded in a radial direction by a double wall with a cavity which is in fluid connection in each case via at least one opening in an outer wall of the double wall with a first flow circuit and a second flow circuit and which can be filled with a gas or a liquid to control a temperature of the bypass duct.

2. The system of claim 1, wherein the first flow circuit comprises at least one first line with at least one first valve and at least one second line with at least one second valve.

3. The system of claim 2, wherein the first flow circuit comprises a container with a first subregion configured to store the gas and a second subregion configured to store the liquid.

4. The system of claim 1, wherein each of the first flow circuit and the second flow circuit comprises at least one pump.

5. The system of claim 1, wherein the second flow circuit comprises at least one third line with at least one third valve and at least one fourth line with at least one fourth valve.

6. The system of claim 5, wherein the second flow circuit further comprises a liquid reservoir fluidly coupled to the at least one third line and the at least one fourth line.

7. A method comprising:

controlling a temperature of a bypass duct of an exhaust gas recirculation system by thermally insulating or cooling a cavity of the bypass duct, wherein the cavity is configured to receive a gas or a liquid from a first reservoir and a second reservoir, respectively.

8. The method of claim 7, wherein the thermally insulating the bypass duct includes flowing the gas from the first reservoir to the cavity via a first passage having a first valve and flowing the liquid out of the cavity to the first reservoir via a second passage having a second valve as the gas flows into the cavity.

9. The method of claim 8, wherein the first valve and the second valve are in fully open positions, and where the cavity is further coupled to the second reservoir via a third passage and a fourth passage comprising third and fourth valves, respectively, and where the third and fourth valves are in a fully closed position during the thermally insulating.

10. The method of claim 9, wherein the cooling the bypass duct includes flowing the liquid from the second reservoir to the cavity via the third passage, and where the liquid continuously flows through the second reservoir, the third passage, the cavity, and the fourth passage.

11. The method of claim 10, wherein the cooling the bypass duct further includes moving the first valve and the second valve to fully closed positions, and where the cavity expels the gas through a gas valve as the liquid flows into the cavity.

12. The method of claim 8, wherein the controlling further includes heating the bypass duct by flowing the liquid to the bypass duct.

13. A system comprising:

an EGR system having an EGR cooler and an EGR cooler bypass, where the EGR cooler bypass is double walled with a cavity located therein;

a first reservoir comprising a first subregion and a second subregion, where the first subregion stores a gas and is fluidly coupled to the cavity via a first passage and where the second subregion stores a liquid and is fluidly coupled to the cavity via a second passage; and a second reservoir configured to store the liquid, and where a third passage and a fourth passage fluidly couple the second reservoir to the cavity.

14. The system of claim 13, wherein the first passage comprises a first valve between the first subregion and the cavity for controlling a gas flow from the first subregion to the cavity, and where the second passage comprises a second valve for controlling a liquid flow from the cavity to the second subregion.

15. The system of claim 14, wherein the third passage comprises a third valve between the second reservoir and the cavity for controlling a liquid flow from the second reservoir to the cavity, and where the fourth passage comprises a fourth valve for controlling a liquid flow from the cavity to the second reservoir.

16. The system of claim 13, further comprising a fifth passage fluidly coupling the second subregion of the first reservoir to the second reservoir, the fifth passage further comprising a fifth valve for controlling a liquid flow from the second subregion to the second reservoir.

17. The system of claim 13, wherein the cavity is annular and surrounds an entirety of the EGR cooler bypass.

18. The system of claim 13, wherein the gas is air and the liquid is water.

19. The system of claim 13, further comprising a controller with computer-readable instructions that when executed enable the controller to:

close third and fourth valves of the third passage and the fourth passage, respectively, and open first and second valves of the first passage and the second passage, respectively, to flow the gas to the cavity in conjunction with an evacuation of the liquid from the cavity to thermally insulate the EGR cooler bypass.

20. The system of claim 19, wherein the controller further includes computer-readable instructions that when executed enable the controller to:

cool the EGR cooler bypass by closing the first and second valves and opening the third and fourth valves to flow the liquid to the cavity as the gas is forced out of the cavity through a gas valve.

* * * * *